US011315534B2

(12) United States Patent
Wan et al.

(10) Patent No.: US 11,315,534 B2
(45) Date of Patent: Apr. 26, 2022

(54) METHOD, APPARATUS, TERMINAL AND STORAGE MEDIUM FOR MIXING AUDIO

(71) Applicant: GUANGZHOU KUGOU COMPUTER TECHNOLOGY CO., LTD., Guangzhou (CN)

(72) Inventors: Jingxuan Wan, Guangzhou (CN); Chunzhi Xiao, Guangzhou (CN)

(73) Assignee: GUANGZHOU KUGOU COMPUTER TECHNOLOGY CO., LTD., Guangzhou (CN)

( * ) Notice: Subject to any disclaimer, the term of this patent is extended or adjusted under 35 U.S.C. 154(b) by 230 days.

(21) Appl. No.: 16/617,920

(22) PCT Filed: Nov. 27, 2018

(86) PCT No.: PCT/CN2018/117767
§ 371 (c)(1),
(2) Date: Nov. 27, 2019

(87) PCT Pub. No.: WO2019/242235
PCT Pub. Date: Dec. 26, 2019

(65) Prior Publication Data

US 2021/0272542 A1 Sep. 2, 2021

(30) Foreign Application Priority Data

Jun. 22, 2018 (CN) ..... 201810650947.5

(51) Int. Cl.
*G10H 1/00* (2006.01)
*G10H 1/38* (2006.01)
*G10H 1/40* (2006.01)

(52) U.S. Cl.
CPC ..... *G10H 1/0025* (2013.01); *G10H 1/38* (2013.01); *G10H 1/40* (2013.01);
(Continued)

(58) Field of Classification Search
CPC ..... G10H 1/0025; G10H 1/38; G10H 1/40; G10H 2210/076; G10H 2210/125; G10H 2210/131
(Continued)

(56) References Cited

U.S. PATENT DOCUMENTS 10,074,351 B2 * 9/2018 Zhao ..... G11B 27/031
10,283,134 B2 * 5/2019 Zhao ..... G10L 21/034
(Continued)

FOREIGN PATENT DOCUMENTS

CN 1838229 A 9/2006
CN 101080763 A 11/2007
(Continued)

OTHER PUBLICATIONS

International search report of PCT application No. PCT/CN2018/117767 dated Mar. 27, 2019.
(Continued)

*Primary Examiner* — Christina M Schreiber
(74) *Attorney, Agent, or Firm* — Ice Miller LLP

(57) ABSTRACT

The present disclosure provides a method for mixing audio, pertaining to the technical field of multimedia. The method includes: after acquiring an audio material to be mixed, determining a beat feature of a target audio, performing beat adjustment on the audio material based on the beat feature of the target audio; and performing audio mixing on the target audio based on the audio material adjusted by the beat adjustment.

17 Claims, 2 Drawing Sheets

(52) U.S. Cl.
CPC . *G10H 2210/076* (2013.01); *G10H 2210/125* (2013.01); *G10H 2210/131* (2013.01)

(58) Field of Classification Search
USPC ..... 84/609
See application file for complete search history.

(56) References Cited

U.S. PATENT DOCUMENTS

| | | | | |
|---|---|---|---|---|
| 10,331,098 | B2 * | 6/2019 | Song | H04L 67/306 |
| 10,403,255 | B2 * | 9/2019 | Zhao | G11B 20/10 |
| 10,665,218 | B2 * | 5/2020 | Zhao | G10H 1/366 |
| 10,924,877 | B2 * | 2/2021 | Liu | H04S 7/302 |
| 11,039,261 | B2 * | 6/2021 | Liu | H04S 5/005 |
| 2008/0190268 | A1 * | 8/2008 | McNally | G10H 1/0025 84/609 |
| 2009/0019995 | A1 * | 1/2009 | Miyajima | G11B 27/034 84/625 |
| 2012/0118127 | A1 * | 5/2012 | Miyajima | G10H 1/0025 84/612 |
| 2015/0081064 | A1 * | 3/2015 | Ball | G10H 1/0025 700/94 |
| 2017/0090860 | A1 * | 3/2017 | Gehring | G10G 1/00 |
| 2020/0143779 | A1 * | 5/2020 | Xiao | G10L 21/013 |
| 2021/0272542 | A1 * | 9/2021 | Wan | G10H 1/0025 |

FOREIGN PATENT DOCUMENTS

| | | | |
|---|---|---|---|
| CN | 101160615 | A | 4/2008 |
| CN | 101211643 | A | 7/2008 |
| CN | 101322179 | A | 12/2008 |
| CN | 101322180 | A | 12/2008 |
| CN | 102568482 | A | 7/2012 |
| CN | 102956224 | A | 3/2013 |
| CN | 103425901 | A | 12/2013 |
| CN | 103928037 | A | 7/2014 |
| CN | 105659314 | A | 6/2016 |
| CN | 106157944 | A | 11/2016 |
| CN | 106558314 | A | 4/2017 |
| CN | 106652997 | A | 5/2017 |
| CN | 107871012 | A | 4/2018 |
| CN | 108831425 | A | 11/2018 |
| EP | 1073056 | A2 | 1/2001 |
| EP | 1162621 | A1 | 12/2001 |
| EP | 1638100 | A1 | 3/2006 |
| EP | 1830347 | A1 | 9/2007 |
| EP | 1923863 | A1 | 5/2008 |
| WO | WO2017058844 | A1 | 4/2017 |

OTHER PUBLICATIONS

Second office action of Chinese application No. 201810650947.5 dated Feb. 22, 2021.
First office action of Chinese application No. 201810650947.5 dated Mar. 20, 2002.
Extended European search report of counterpart EP application No. 18919406.1 dated Apr. 22, 2020.

* cited by examiner

METHOD, APPARATUS, TERMINAL AND STORAGE MEDIUM FOR MIXING AUDIO

CROSS REFERENCE TO RELATED APPLICATION

The present application is a national stage of PCT Application No. PCT/CN2018/117767 filed on Nov. 27, 2018, which claims priority to Chinese Patent Application No. 201810650947.5, filed on Jun. 22, 2018 and entitled "METHOD, APPARATUS AND STORAGE MEDIUM FOR MIXING AUDIO", the entire contents of which are incorporated herein by reference.

TECHNICAL FIELD

The present disclosure relates to the technical field of multimedia, and in particular, relates to a method, an apparatus, a terminal and a storage medium for mixing audio.

BACKGROUND

Currently, audio mixing is generally needed to improve the freshness of songs for the sake of increasing the entertainability of the songs. Audio mixing for a song refers to mixing other musical instrumental materials on the basis of the original song, such that the song experiencing audio mixing would have audio features of these musical instrumental materials.

SUMMARY

The embodiments of the present disclosure provide a method, an apparatus, a terminal and a storage medium for mixing audio.

In an aspect, a method for mixing audio is provided, including:

acquiring an audio material to be mixed;

determining a beat feature of a target audio for audio mixing, the beat feature being a correspondence between a beat used in the target audio and time point information;

performing beat adjustment on the audio material based on the beat feature of the target audio; and performing audio mixing on the target audio based on the audio material adjusted by the beat adjustment.

In another aspect, an apparatus for mixing audio is provided, including:

an acquiring module, configured to acquire an audio material to be mixed;

a determining module, configured to determine a beat feature of a target audio for audio mixing, the beat feature being a correspondence between a beat used in the target audio and time point information;

an adjusting module, configured to perform beat adjustment on the audio material based on the beat feature of the target audio; and a processing module, configured to perform audio mixing on the target audio based on the audio material adjusted by the beat adjustment.

In yet another aspect, a terminal for mixing audio is provided, comprising:

a processor; and a memory for storing instructions executable by the processor;

wherein the processor is configured to perform following operations:

acquiring an audio material to be mixed;

determining a beat feature of a target audio for audio mixing, the beat feature being a correspondence between a beat used in the target audio and time point information;

performing beat adjustment on the audio material based on the beat feature of the target audio; and performing audio mixing on the target audio based on the audio material adjusted by the beat adjustment.

In still yet another aspect, a computer-readable storage medium is provided, on which instructions are stored, and when being executed by a processor, the instructions cause the processor to perform following operations:

acquiring an audio material to be mixed;

determining a beat feature of a target audio for audio mixing, the beat feature being a correspondence between a beat used in the target audio and time point information;

performing beat adjustment on the audio material based on the beat feature of the target audio; and performing audio mixing on the target audio based on the audio material adjusted by the beat adjustment.

In still yet another aspect, a computer program product comprising instructions is provided. When the computer program product runs on the computer, the instructions cause the computer to perform following operations:

acquiring an audio material to be mixed;

determining a beat feature of a target audio for audio mixing, the beat feature being a correspondence between a beat used in the target audio and time point information;

performing beat adjustment on the audio material based on the beat feature of the target audio; and performing audio mixing on the target audio based on the audio material adjusted by the beat adjustment.

BRIEF DESCRIPTION OF THE DRAWINGS

In order to describe the technical solutions in the embodiments of the present disclosure more clearly, the accompanying drawings required for describing the embodiments are introduced briefly as follows. Apparently, the accompanying drawings in the following description show merely some embodiments of the present disclosure, and a person of ordinary skill in the art may also derive other drawings from these accompanying drawings without any creative effort.

DETAILED DESCRIPTION

The embodiments of the present disclosure will be described in further details with reference to the accompanying drawings, so that the objects, technical solutions, and advantages of the present disclosure would be presented more clearly.

Figure 1:
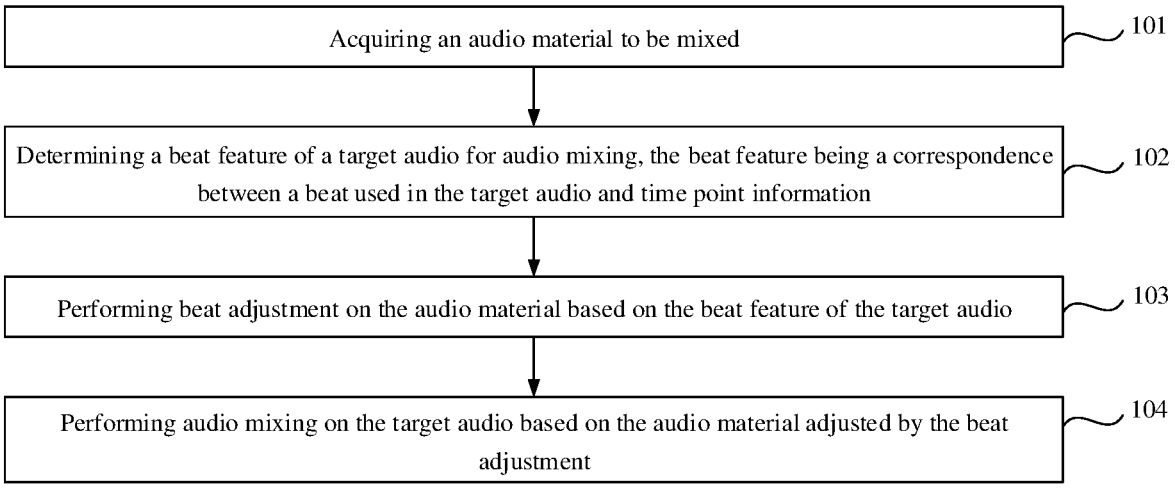
FIG. 1 shows a flowchart of a method for mixing audio according to an embodiment of the present disclosure.

FIG. 1 shows a flowchart of a method for mixing audio according to an embodiment of the present disclosure. As illustrated in FIG. 1, the method includes the following steps:

step 101 includes acquiring an audio material to be mixed.

In one possible implementation manner, step 101 may include: selecting a target musical instrumental material from an audio material library, the audio material library including at least one musical instrumental material, each musical instrumental material being an audio having a designated beat and a designated time duration; and splicing the target musical instrumental material cyclically to obtain the audio material to be mixed, and a time duration of the audio material to be mixed being the same as that of the target audio.

Each musical instrumental material in the audio material library is pre-produced. When each musical instrumental material is an audio having a designated beat and a designated time duration, it means that each musical instrumental material has only one type of beat, and each musical instrumental material is an audio with a repeated melody. For example, the musical instrumental material library includes musical instrumental materials such as a drum material, a piano material, a bass material, a guitar material and the like. Each musical instrumental material has a time duration of only 2 seconds, and each musical instrumental material only includes one type of beat.

Since the time duration of each musical instrumental material is generally short, in order to preform audio mixing for a target audio by using the target musical instrumental material, the audio material to be mixed needs to be acquired first based on the target musical instrumental material. That is, the target musical instrumental material is cyclically spliced, and the cyclically spliced audio piece would be used as the audio material to be mixed. By cyclical splicing, it is intended to make the time duration of the audio material to be mixed consistent with that of the target audio. For example, the target musical instrumental material is a drum material having a time duration of 2 seconds, and the target audio has a time duration of 3 minutes, then, the drum material may be cyclically spliced to obtain a to-be-mixed audio material with a time duration of 3 minutes. In addition, since the target musical instrumental material has a designated beat, the cyclically spliced audio material also includes only one type of beat.

Optionally, in the embodiment of the present disclosure, if the time duration of the musical instrumental material is consistent with the time duration of the target audio, the audio material to be mixed may also be directly derived from a musical instrumental material selected by a user, and thus the above cyclical splicing step is not needed. In this case, the audio mixed material may include only one type of beat, or may include a plurality of types of beats, which is not limited in the embodiments of the present disclosure.

Further, some types of musical instrumental materials may only have a beat, whereas some types of musical instrumental materials may have a chord in addition to the beat. For example, a drum material has only the beat, whereas a guitar material has both the beat and the chord. With respect to a musical instrumental material having both the beat and the chord, the musical instrumental material may only have one type of chord, or may include a plurality of types of chords, which is not limited in the embodiments of the present disclosure.

Step 102 includes determining a beat feature of a target audio for audio mixing, the beat feature being a correspondence between a beat used in the target audio and time point information.

The time point information refers to time point information in a playback time axis of the target audio. For example, if the target audio is a song which has a time duration of 3 minutes, then the determining the beat feature of the target audio indicates determining that 2 beats are employed within a period of second 0 to second 3 of the song, and 4 beats are employed within a period of second 3 to second 8 seconds, etc.

Step 103 includes performing beat adjustment on the audio material based on the beat feature of the target audio.

Since the beat feature refers to the correspondence between the beat used in the target data and the time point information, step 103 may include: segmenting the target audio into a plurality of first-type audio segments based on the beat feature of the target audio, each first-type audio segment corresponding to one beat; determining a plurality of first-type material segments of the audio material to be mixed based on time point information of each of the plurality of first-type audio segments, each first-type material segment having one corresponding first-type audio segment, and time point information of each first-type material segment being the same as the time point information of the corresponding first-type audio segment; and adjusting a beat of each of the plurality of first-type material segments to the beat of the corresponding first-type audio segment.

For example, the target audio has a time duration of 30 seconds, and the audio material to be mixed has 3 beats. After the target audio is segmented based on the beat feature, three first-type audio segments are obtained, respectively, a first-type audio segment 1, a first-type audio segment 2 and a first-type audio segment 3. The time point information of the first-type audio segment 1 is from second 0 to second 9, and the first-type audio segment 1 has 2 beats; the time point information of the first-type audio segment 2 is from second 9 to second 15, and the first-type audio segment 2 has 4 beats; and the time point information of the first-type audio segment 3 from second 15 to second 30, and the first-type audio segment 3 has 2 beats. In this case, based on the time point information of these three audio segments, a first-type material segment with the time point information from second 0 to second 9, a first-type material segment with the time point information from second 9 to second 15, and a first-type material segment with the time point information from second 15 to second 30 in the audio material to be mixed may be determined.

In this case, in the audio material to be mixed, the first-type material segment with the time point information from second 0 to second 9 is adjusted from 3 beats to 2 beats, the first-type material segment with the time point information from second 9 to second 15 is adjusted from 3 beats to 4 beats, and the first-type material segment with the time point information from second 15 to second 30 is adjusted from 3 beats to 2 beats. The beat of any of the first-type material segments after being adjusted by the beat adjustment is consistent with the first-type audio segment with the same time point information. That is, through the beat adjustment on the audio material to be mixed, the audio material may have the same beat feature with the target audio. In this way, when the audio mixing is performed on the target audio based on the audio material adjusted by the beat adjustment, the audio obtained from audio mixing could be prevented from losing the original rhythm of the target audio.

Step 104 includes performing audio mixing on the target audio based on the audio material adjusted by the beat adjustment.

In one possible implementation manner, step 104 may include: after the beat adjustment on the audio material to be mixed based on the beat feature, directly combining the audio material adjusted by the beat adjustment with the target audio to implement audio mixing for the target audio.

Since some types of musical instrumental materials may only have beats, in this case, audio mixing may be practiced for the target audio only through the above step 101 to step 104. However, some types of musical instrumental materials also have chords in addition to the beats. With respect to a musical instrumental material having both the beat and the chord, after an audio material to be mixed is obtained, if the beat adjustment is only performed on the audio material, the chord feature of the audio material may be inconsistent with the chord feature of the target audio, and thus the audio material could not be successfully combined with the target audio. Accordingly, with respect to a musical instrumental material having both the beat and the chord, after the beat adjustment is performed on the audio material to be mixed, the chord adjustment may also be performed on the audio material, such that the audio mixing is performed for the target audio based on the audio material adjusted by the chord adjustment. Therefore, in another possible implementation manner, step 104 may include: performing chord adjustment on the audio material adjusted by the beat adjustment; and combining the audio material adjusted by the chord adjustment with the target audio.

In the embodiment of the present disclosure, the chord adjustment may be performed on the audio material adjusted by the beat adjustment through the following two implementation manners:

In a first implementation manner, a chord feature of the target audio is determined, wherein the chord feature is a correspondence between a chord employed in the target audio and the time point information; and based on the chord feature of the target audio, chord adjustment is performed on the audio material adjusted by the beat adjustment.

The determining the chord feature of the target audio means determining what chord the target audio employs, and in which time period the chord is employed. For example, the target audio may be a song which has a time duration of 3 minutes, then, determining the chord feature of the target audio indicates determining that an E chord is employed within a period of second 0 to second 3 of the song, and a G chord is employed within a period of second 3 to second 8.

In addition, the performing chord adjustment on the audio material adjusted by the beat adjustment based on the chord feature of the target audio may be implemented by segmenting the target audio into a plurality of second-type audio segments based on the chord feature of the target audio, each second-type audio segment corresponding to one chord; determining a plurality of second-type material segments of the audio material adjusted by the beat adjustment based on time point information of each of the plurality of second-type audio segments, each second-type material segment having one corresponding second-type audio segment, and time point information of each second-type material segment being the same as the time point information of the corresponding second-type audio segment; and adjusting a chord of each of the plurality of second-type material segments to the chord of the corresponding second-type audio segment.

For example, the target audio has a time duration of 30 seconds, and the audio material to be mixed has only a chord A. After the target audio is segmented based on the chord feature, three second-type audio segments are obtained, respectively, a second-type audio segment 1, a second-type audio segment 2 and a second-type audio segment 3. The time point information of the second-type audio segment 1 is from second 0 to second 9, and the second-type audio segment 1 has a chord C; the time point information of the second-type audio segment 2 is from second 9 to second 15, and the second-type audio segment 2 has a chord A; and the time point information of the second-type audio segment 3 from second 15 to second 30, and the second-type audio segment 3 has a chord H. In this case, based on the time point information of these three audio segments, a second-type material segment with the time point information from second 0 to second 9, a second-type material segment with the time point information from second 9 to second 15, and a second-type material segment with the time point information from second 15 to second 30 in the audio material adjusted by the beat adjustment may be determined.

In this case, in the audio material adjusted by the beat adjustment, the second-type material segment with the time point information from second 0 to second 9 is adjusted from chord A to chord C, the chord of the second-type material segment with the time point information from second 9 to second 15 is kept unchanged, and the second-type material segment with the time point information from second 15 to second 30 is adjusted from chord A to chord H. Apparently, the chord of any of the second-type material segments adjusted by the chord adjustment is consistent with the chord of the second-type audio segment with the same time point information. That is, by performing the chord adjustment on the audio mixed material adjusted by the beat adjustment, the audio material to be mixed has the same beat feature and chord feature with the target audio, which means that the audio material subjects to both adjustments has a consistent rhythm with the target audio. In this way, when the audio mixing is performed on the target audio based on the audio material subsequently, the audio after being experiencing the audio mixing may be prevented from losing the original rhythm of the target audio.

In a second implementation manner, a tonality of the target audio is determined, and the chord of the to-be-mixed audio material adjusted by the beat adjustment is adjusted to a chord consistent with the determined tonality based on the tonality of the target audio.

In the first implementation manner, based on the chord feature of the target audio, the chord adjustment is performed on the audio material adjusted by the beat adjustment. Firstly, all the chords included in the target audio are analyzed, such that the audio material adjusted by the chord adjustment has the same chord feature with the target audio. As such, the efficiency of the chord adjustment may be low. Since the chord generally corresponds to the tonality, and a song generally has one tonality, in the embodiments of the present disclosure, the chords in the audio material may be uniformly adjusted based on the tonality of the target audio, without any need to adjust the chord in the audio material based on each chord in the target audio. In this way, the efficiency of the chord adjustment could be improved. The tonality refers to a temperament of a tonic of the target audio.

Optionally, after determining the tonality of the target audio, the chord of the audio material adjusted by the beat adjustment could be adjusted to the chord consistent with the tonality determined based on the tonality of the target audio. For example, if the tonality of the target audio is C-major, and the audio material adjusted by the beat adjustment has only one type of chord which is the chord A, then the chord of the audio material adjusted by the beat adjustment could be adjusted to the chord consistent with the determined tonality by using the chord A as A-major, adjusting the audio material from A-major to C-major, which is equivalent to adjusting the chord A in the audio material to the chord C.

It should be noted that for the musical instrumental material having both the beat and the chord, after the audio material to be mixed is acquired, in the above implementation manner, a beat adjustment may be performed on the audio material first, and the chord adjustment could be performed on the audio material. Nevertheless, a chord adjustment may be performed on the audio material first, and then a beat adjustment could be performed on the audio material, which is not limited in the embodiments of the present disclosure.

In the embodiments of the present disclosure, in order to keep the audio being experiencing the audio mixing maintaining the original rhythm of the target audio, a beat adjustment may be performed on the audio material, or both a beat adjustment and a chord adjustment may be performed on the audio material; further, the chord adjustment may be performed based on the chord feature of the target audio or based on the tonality of the target audio. That is, the embodiments of the present disclosure provide three different adjustment modes.

In addition, since the audio material to be mixed is determined based on the target musical instrumental material in the audio material library, an adjustment type may be defined for each musical instrumental material in the audio material library. In one possible implementation manner, three adjustment types are included. The first type is a "beat type", which is indicative of adjusting the audio material based on the beat feature of the target audio. The second type is a "beat+chord type", which is indicative of adjusting the audio material based on the beat feature and the chord feature of the target audio. The third type is a "beat+tonality type", which is indicative of adjusting the audio material based on the beat feature and the tonality of the target audio.

In the related art, when audio mixing needs to be performed for a target song, the target song is firstly segmented based on pitches to obtain a plurality of audio segments. Each audio segment has a corresponding pitch. The pitch refers to the number of vibrations in the sound within one second. A musical instrumental material to be mixed is also an audio segment. The musical instrumental material is divided into a plurality of material segments based on chords. Each material segment has a corresponding chord. A chord generally corresponds to a plurality of pitches. During audio mixing, for each material segment of the musical instrumental material, an audio segment whose pitch corresponds to the chord of the material segment is selected from the plurality of audio segments. Afterwards, the selected audio segment is combined with the material segment to obtain a mixed audio segment. Similarly, when the above operations have been performed for all the material segments, a plurality of mixed audio segments would be obtained, and these mixed audio segments will be combined to obtain a song experiencing audio mixing.

During the process of audio mixing for a target song, the musical instrumental material refers to an audio segment including a plurality of chords. When audio mixing is performed for the target song based on the chords in the musical instrumental material, it means that the audio segments obtained from segmenting the target song are resorted according to the sequence of chords in the musical instrumental material. As a result, the song experiencing audio mixing would be greatly different from the target song, and the original rhythm of the target song could not be retained, which is unfavorable to the promotion of the above audio mixing method.

According to the embodiment of the present disclosure, after acquiring an audio material to be mixed, determining a beat feature of a target audio, performing beat adjustment on the audio material based on the beat feature of the target audio; and performing audio mixing on the target audio based on the audio material adjusted by the beat adjustment. Since the beat feature refers to a correspondence between a beat used in the target audio and time point information, it can be seen that in the present disclosure, a beat adjustment is performed on the audio material based on the correspondence between a beat used in the target audio and time point information, instead of re-sorting the audio segments obtained by segmenting a target song based on a chord sequence in a musical instrumental material. In this way, by performing audio mixing on the target audio based on the audio material being adjusted by the beat adjustment, the original rhythm of the target audio could be retained, which is favorable to the promotion of the method for mixing audio according to the present disclosure.

Figure 2:
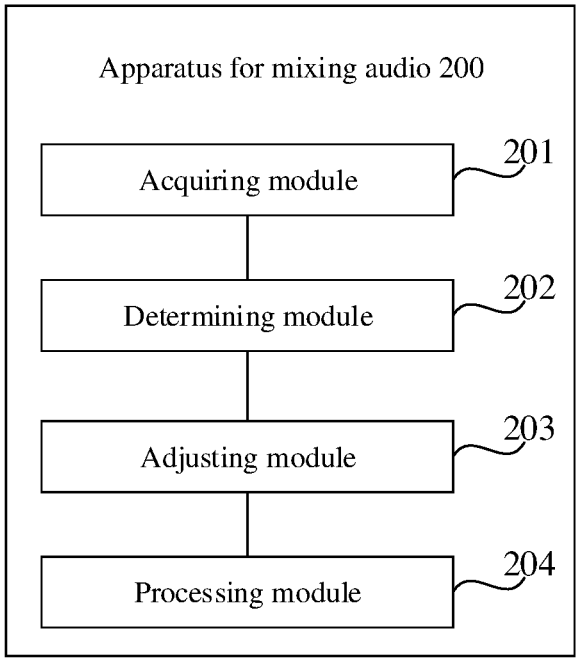
FIG. 2 shows a block diagram of an apparatus for mixing audio according to an embodiment of the present disclosure.

FIG. 2 illustrates an apparatus for mixing audio 200 according to an embodiment of the present disclosure. As illustrated in FIG. 2, the apparatus 200 includes:

an acquiring module 201, configured to acquire an audio material to be mixed;

a determining module 202, configured to determine a beat feature of a target audio for audio mixing, the beat feature being a correspondence between a beat used in the target audio and time point information;

an adjusting module 203, configured to perform beat adjustment on the audio material based on the beat feature of the target audio; and a processing module 204, configured to perform audio mixing on the target audio based on the audio material adjusted by the beat adjustment.

Optionally, the acquiring module 203 is further configured to:

segment the target audio into a plurality of first-type audio segments based on the beat feature of the target audio, each first-type audio segment corresponding to one beat;

determine a plurality of first-type material segments of the audio material to be mixed based on time point information of each of the plurality of first-type audio segments, each first-type material segment having one corresponding first-type audio segment, and time point information of each first-type material segment being the same as the time point information of the corresponding first-type audio segment; and adjust a beat of each of the plurality of first-type material segments to the beat of the corresponding first-type audio segment.

Optionally, the processing module 204 includes:

an adjusting unit, configured to perform chord adjustment on the audio material adjusted by the beat adjustment; and a combining unit, configured to combine the audio material adjusted by the chord adjustment with the target audio.

Optionally, the adjusting unit is further configured to:

determine a chord feature of the target audio, the chord feature being a correspondence between a chord used in the target audio and time point information; and perform chord adjustment on the audio material adjusted by the beat adjustment based on the chord feature of the target audio.

Optionally, the adjusting unit is further configured to:

segment the target audio into a plurality of second-type audio segments based on the chord feature of the target audio, each second-type audio segment corresponding to one chord;

determine a plurality of second-type material segments of the audio material adjusted by the beat adjustment based on time point information of each of the plurality of second-type audio segments, each second-type material segment having one corresponding second-type audio segment, and time point information of each second-type material segment being the same as the time point information of the corresponding second-type audio segment; and adjust a chord of each of the plurality of second-type material segments to the chord of the corresponding second-type audio segment.

Optionally, the adjusting unit is further configured to:

determine a tonality of the target audio, the tonality being a temperament of a tonic of the target audio; and adjust the chord of the audio material adjusted by the beat adjustment to a chord consistent with the determined tonality based on the tonality of the target audio.

Optionally, the acquiring module 201 is further configured to:

select a target musical instrumental material from an audio material library, the audio material library comprising at least one musical instrumental material, each musical instrumental material being an audio having a designated beat and a designated time duration; and splice the target musical instrumental material cyclically to obtain the audio material to be mixed, a time duration of the audio material to be mixed being the same as that of the target audio.

According to the embodiment of the present disclosure, after acquiring an audio material to be mixed, determining a beat feature of a target audio, performing beat adjustment on the audio material based on the beat feature of the target audio; and performing audio mixing on the target audio based on the audio material adjusted by the beat adjustment. Since the beat feature refers to a correspondence between a beat used in the target audio and time point information, it can be seen that in the present disclosure, a beat adjustment is performed on the audio material based on the correspondence between a beat used in the target audio and time point information, instead of re-sorting the audio segments obtained by segmenting a target song based on a chord sequence in a musical instrumental material. In this way, by performing audio mixing on the target audio based on the audio material being adjusted by the beat adjustment, the original rhythm of the target audio could be retained, which is favorable to the promotion of the method for mixing audio according to the present disclosure.

It should be noted that, during audio mixing by the apparatus for mixing audio according to the above embodiments, the apparatus is described by only using division of the above functional modules as examples. In practice, the functions may be assigned to different functional modules for implementation as required. To be specific, the internal structure of the apparatus is divided into different functional modules to implement all or parts of the above-described functions. In addition, the apparatus for mixing audio according to the above embodiments is based on the same inventive concept as the method for mixing audio according to the embodiments of the present disclosure. The specific implementation is elaborated in the method embodiments, which is not be detailed herein any further.

Figure 3:
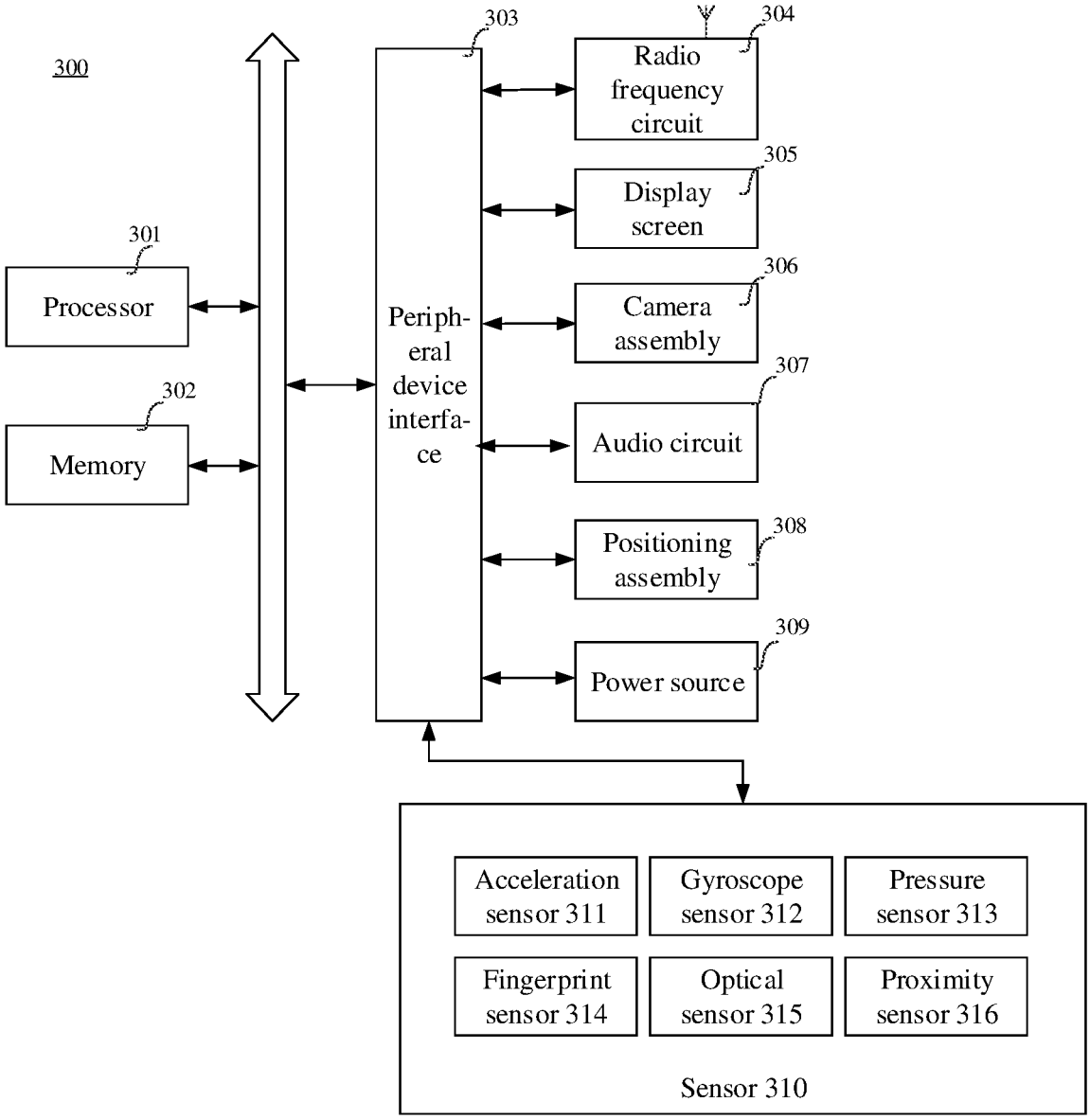
FIG. 3 shows a schematic structural diagram of a terminal according to an embodiment of the present disclosure.

FIG. 3 is a structural block diagram of a terminal 300 according to an exemplary embodiment of the present disclosure. The terminal 300 may be a smart phone, a tablet computer, a Moving Picture Experts Group Audio Layer III (MP3) player, a Moving Picture Experts Group Audio Layer IV (MP4) player, a laptop computer or a desktop computer. The terminal 300 may also be referred to as a user equipment, a portable terminal, a laptop terminal, a desktop terminal or the like.

Generally, the terminal 300 includes a processor 301 and a memory 302.

The processor 301 may include one or a plurality of processing cores, for example, a four-core processor, an eight-core processor or the like. The processor 301 may be practiced based on a hardware form of at least one of digital signal processing (DSP), field-programmable gate array (FPGA), and programmable logic array (PLA). The processor 301 may further include a primary processor and a secondary processor. The primary processor is a processor configured to process data in an active state, and is also referred to as a central processing unit (CPU); and the secondary processor is a low-power consumption processor configured to process data in a standby state. In some embodiments, the processor 301 may be integrated with a graphics processing unit (GPU), wherein the GPU is configured to render and draw the content to be displayed on the screen. In some embodiments, the processor 301 may further includes an artificial intelligence (AI) processor, wherein the AI processor is configured to process calculate operations related to machine learning.

The memory 302 may include one or a plurality of computer-readable storage media, wherein the computer-readable storage medium may be non-transitory. The memory 302 may include a high-speed random access memory, and a non-volatile memory, for example, one or a plurality of magnetic disk storage devices or flash storage devices. In some embodiments, the non-transitory computer-readable storage medium in the memory 302 may be configured to store at least one instruction, wherein the at least one instruction is executed by the processor 301 to perform the method for displaying pitch information in a live streaming studio according to the embodiments of the present disclosure.

In some embodiments, the terminal 300 may optionally include a peripheral device interface 303 and at least one peripheral device. The processor 301, the memory 302 and the peripheral device interface 303 may be connected to each other via a bus or a signal line. The at least one peripheral device may be connected to the peripheral device interface 303 via a bus, a signal line or a circuit board. Specifically, the peripheral device includes at least one of a radio frequency circuit 304, a touch display screen 305, a camera assembly 306, an audio circuit 307, a positioning assembly 308 and a power source 309.

The peripheral device interface 303 may be configured to connect the at least one peripheral device related to input/output (I/O) to the processor 301 and the memory 302. In some embodiments, the processor 301, the memory 302 and the peripheral device interface 303 are integrated on the same chip or circuit board. In some other embodiments, any one or two of the processor 301, the memory 302 and the peripheral device interface 303 may be practiced on a separate chip or circuit board, which is not limited in this embodiment.

The radio frequency circuit 304 is configured to receive and transmit a radio frequency (RF) signal, which is also referred to as an electromagnetic signal. The radio frequency circuit 304 communicates with a communication network or another communication device via the electromagnetic signal. The radio frequency circuit 304 converts an electrical signal to an electromagnetic signal and sends the signal, or converts a received electromagnetic signal to an electrical signal. Optionally, the radio frequency circuit 304 includes an antenna system, an RF transceiver, one or a plurality of amplifiers, a tuner, an oscillator, a digital signal processor, a codec chip set, a subscriber identification module card or the like. The radio frequency circuit 304 may communicate with another terminal based on a wireless communication protocol. The wireless communication protocol includes, but not limited to: a metropolitan area network, generations of mobile communication networks (including 2G, 3G, 4G and 5G), a wireless local area network and/or a wireless fidelity (WiFi) network. In some embodiments, the radio frequency circuit 3024 may further include a near field communication (NFC)-related circuits, which is not limited in the present disclosure.

The display screen 305 may be configured to display a user interface (UI). The UE may include graphics, texts, icons, videos and any combination thereof. When the display screen 305 is a touch display screen, the display screen 305 may further have the capability of acquiring a touch signal on a surface of the display screen 305 or above the surface of the display screen 305. The touch signal may be input to the processor 301 as a control signal, and further processed therein. In this case, the display screen 305 may be further configured to provide a virtual button and/or a virtual keyboard or keypad, also referred to as a soft button and/or a soft keyboard or keypad. In some embodiments, one display screen 305 may be provided, which is arranged on a front panel of the terminal 300. In some other embodiments, at least two display screens 305 are provided, which are respectively arranged on different surfaces of the terminal 300 or designed in a folded fashion. In still some other embodiments, the display screen 305 may be a flexible display screen, which is arranged on a bent surface or a folded surface of the terminal 300. Even, the display screen 305 may be further arranged to an irregular pattern which is non-rectangular, that is, a specially-shaped screen. The display screen 305 may be fabricated from such materials as a liquid crystal display (LCD), an organic light-emitting diode (OLED) and the like.

The camera assembly 306 is configured to capture an image or a video. Optionally, the camera assembly 306 includes a front camera and a rear camera. Generally, the front camera is arranged on a front panel of the terminal, and the rear camera is arranged on a rear panel of the terminal. In some embodiments, at least two rear cameras are arranged, which are respectively any one of a primary camera, a depth of field (DOF) camera, a wide-angle camera and a long-focus camera, such that the primary camera and the DOF camera are fused to implement the background virtualization function, and the primary camera and the wide-angle camera are fused to implement the panorama photographing and virtual reality (VR) photographing functions or other fused photographing functions. In some embodiments, the camera assembly 306 may further include a flash. The flash may be a single-color temperature flash or a double-color temperature flash. The double-color temperature flash refers to a combination of a warm-light flash and a cold-light flash, which may be used for light compensation under different color temperatures.

The audio circuit 307 may include a microphone and a speaker. The microphone is configured to capture an acoustic wave of a user and an environment, and convert the acoustic wave to an electrical signal and output the electrical signal to the processor 301 for further processing, or output to the radio frequency circuit 304 to implement voice communication. For the purpose of stereo capture or noise reduction, a plurality of such microphones may be provided, which are respectively arranged at different positions of the terminal 300. The microphone may also be a microphone array or an omnidirectional capturing microphone. The speaker is configured to convert an electrical signal from the processor 301 or the radio frequency circuit 3024 to an acoustic wave. The speaker may be a traditional thin-film speaker, or may be a piezoelectric ceramic speaker. When the speaker is a piezoelectric ceramic speaker, an electrical signal may be converted to an acoustic wave audible by human beings, or an electrical signal may be converted to an acoustic wave inaudible by human beings for the purpose of ranging or the like. In some embodiments, the audio circuit 307 may further include a headphone plug.

The positioning assembly 308 is configured to determine a current geographical position of the terminal 300 to implement navigation or a local based service (LBS). The positioning assembly 308 may be the global positioning system (GPS) from the United States, the Beidou positioning system from China, the Grenas satellite positioning system from Russia or the Galileo satellite navigation system from the European Union.

The power source 309 is configured to supply power for the components in the terminal 300. The power source 309 may be an alternating current, a direct current, a disposable battery or a rechargeable battery. When the power source 309 includes a rechargeable battery, the rechargeable battery may support wired charging or wireless charging. The rechargeable battery may also support the supercharging technology.

In some embodiments, the terminal may further include one or a plurality of sensors 310. The one or plurality of sensors 310 include, but not limited to: an acceleration sensor 311, a gyroscope sensor 312, a pressure sensor 313, a fingerprint sensor 314, an optical sensor 315 and a proximity sensor 316.

The acceleration sensor 311 may detect accelerations on three coordinate axes in a coordinate system established for the terminal 300. For example, the acceleration sensor 311 may be configured to detect components of a gravity acceleration on the three coordinate axes. The processor 301 may control the touch display screen 3025 to display the user interface in a horizontal view or a longitudinal view based on a gravity acceleration signal acquired by the acceleration sensor 311. The acceleration sensor 311 may be further configured to acquire motion data of a game or a user.

The gyroscope sensor 312 may detect a direction and a rotation angle of the terminal 300, and the gyroscope sensor 312 may collaborate with the acceleration sensor 311 to capture a 3D action performed by the user for the terminal 300. Based on the data acquired by the gyroscope sensor 312, the processor 301 may implement the following functions: action sensing (for example, modifying the UE based on an inclination operation of the user), image stabilization during the photographing, game control and inertial navigation.

The force sensor 313 may be arranged on a side frame of the terminal 300 and/or on a lowermost layer of the touch display screen 305. When the force sensor 313 is arranged on the side frame of the terminal 300, a grip signal of the user against the terminal 300 may be detected, and the processor 301 implements left or right hand identification or perform a shortcut operation based on the grip signal acquired by the force sensor 313. When the force sensor 313 is arranged on the lowermost layer of the touch display screen 305, the processor 301 implement control of an operable control on the UI based on a force operation of the user against the touch display screen 305. The operable control includes at least one of a button control, a scroll bar control, an icon control, and a menu control.

The fingerprint sensor 314 is configured to acquire fingerprints of the user, and the processor 301 determines the identity of the user based on the fingerprints acquired by the fingerprint sensor 314, or the fingerprint sensor 314 determines the identity of the user based on the acquired fingerprints. When the user is authenticated, the processor 301 authorizes the user to perform related sensitive operations, wherein the sensitive operations include unlocking the screen, checking encrypted information, downloading software, paying and modifying settings and the like. The fingerprint sensor 314 may be arranged on a front face a back face or a side face of the terminal 300. When the terminal 300 is provided with a physical key or a manufacturer's logo, the fingerprint sensor 314 may be integrated with the physical key or the manufacturer's logo.

The optical sensor 315 is configured to acquire the intensity of ambient light. In one embodiment, the processor 301 may control a display luminance of the touch display screen 305 based on the intensity of ambient light acquired by the optical sensor 315. Specifically, when the intensity of ambient light is high, the display luminance of the touch display screen 305 is up-shifted; and when the intensity of ambient light is low, the display luminance of the touch display screen 305 is down-shifted. In another embodiment, the processor 301 may further dynamically adjust photographing parameters of the camera assembly 306 based on the intensity of ambient light acquired by the optical sensor.

The proximity sensor 316, also referred to as a distance sensor, is generally arranged on the front panel of the terminal 300. The proximity sensor 316 is configured to acquire a distance between the user and the front face of the terminal 300. In one embodiment, when the proximity sensor 316 detects that the distance between the user and the front face of the terminal 300 gradually decreases, the processor 301 controls the touch display screen 305 to switch from an active state to a rest state; and when the proximity sensor 316 detects that the distance between the user and the front face of the terminal 300 gradually increases, the processor 301 controls the touch display screen 305 to switch from the rest state to the active state.

A person skilled in the art may understand that the structure of the terminal as illustrated in FIG. 3 does not construe a limitation on the terminal 300. The terminal may include more components over those illustrated in FIG. 3, or combinations of some components, or employ different component deployments.

The terminal provided in the embodiments of the present disclosure includes:

a processor; and a memory for storing instructions executable by the processor;

wherein the processor is configured to perform following operations:

acquiring an audio material to be mixed;

determining a beat feature of a target audio for audio mixing, the beat feature being a correspondence between a beat used in the target audio and time point information;

performing beat adjustment on the audio material based on the beat feature of the target audio; and performing audio mixing on the target audio based on the audio material adjusted by the beat adjustment.

Optionally, the processor is further configured to perform following operations:

segmenting the target audio into a plurality of first-type audio segments based on the beat feature of the target audio, each first-type audio segment corresponding to one beat;

determining a plurality of first-type material segments of the audio material to be mixed based on time point information of each of the plurality of first-type audio segments, each first-type material segment having one corresponding first-type audio segment, and time point information of each first-type material segment being the same as the time point information of the corresponding first-type audio segment; and adjusting a beat of each of the plurality of first-type material segments to the beat of the corresponding first-type audio segment.

Optionally, the processor is further configured to perform following operations:

performing chord adjustment on the audio material adjusted by the beat adjustment; and combining the audio material adjusted by the chord adjustment with the target audio.

Optionally, the processor is further configured to perform following operations:

determining a chord feature of the target audio, the chord feature being a correspondence between a chord used in the target audio and time point information; and performing chord adjustment on the audio material adjusted by the beat adjustment based on the chord feature of the target audio.

Optionally, the processor is further configured to perform following operations:

segmenting the target audio into a plurality of second-type audio segments based on the chord feature of the target audio, each second-type audio segment corresponding to one chord;

determining a plurality of second-type material segments of the audio material adjusted by the beat adjustment based on time point information of each of the plurality of second-type audio segments, each second-type material segment having one corresponding second-type audio segment, and time point information of each second-type material segment being the same as the time point information of the corresponding second-type audio segment; and adjusting a chord of each of the plurality of second-type material segments to the chord of the corresponding second-type audio segment.

Optionally, the processor is further configured to perform following operations:

determining a tonality of the target audio, the tonality being a temperament of a tonic of the target audio; and adjusting the chord of the audio material adjusted by the beat adjustment to a chord consistent with the determined tonality based on the tonality of the target audio.

Optionally, the processor is further configured to perform following operations:

selecting a target musical instrumental material from an audio material library, the audio material library comprising at least one musical instrumental material, each musical instrumental material being an audio having a designated beat and a designated time duration; and splicing the target musical instrumental material cyclically to obtain the audio material to be mixed, a time duration of the audio material to be mixed being the same as that of the target audio.

An embodiment of the present disclosure further provides a non-transitory computer-readable storage medium, storing instructions which, when being executed by a processor of a mobile terminal, cause the mobile terminal to perform following operations:

acquiring an audio material to be mixed;

determining a beat feature of a target audio for audio mixing, the beat feature being a correspondence between a beat used in the target audio and time point information;

performing beat adjustment on the audio material based on the beat feature of the target audio; and performing audio mixing on the target audio based on the audio material adjusted by the beat adjustment.

Optionally, when the instruction in the storage medium are executed by the processor, the mobile terminal is further caused to perform to perform following operations:

segmenting the target audio into a plurality of first-type audio segments based on the beat feature of the target audio, each first-type audio segment corresponding to one beat;

determining a plurality of first-type material segments of the audio material to be mixed based on time point information of each of the plurality of first-type audio segments, each first-type material segment having one corresponding first-type audio segment, and time point information of each first-type material segment being the same as the time point information of the corresponding first-type audio segment; and adjusting a beat of each of the plurality of first-type material segments to the beat of the corresponding first-type audio segment.

Optionally, when the instruction in the storage medium are executed by the processor, the mobile terminal is further caused to perform to perform following operations:

performing chord adjustment on the audio material adjusted by the beat adjustment; and combining the audio material adjusted by the chord adjustment with the target audio.

Optionally, when the instruction in the storage medium are executed by the processor, the mobile terminal is further caused to perform to perform following operations:

determining a chord feature of the target audio, the chord feature being a correspondence between a chord used in the target audio and time point information; and performing chord adjustment on the audio material adjusted by the beat adjustment based on the chord feature of the target audio.

Optionally, when the instruction in the storage medium are executed by the processor, the mobile terminal is further caused to perform to perform following operations:

segmenting the target audio into a plurality of second-type audio segments based on the chord feature of the target audio, each second-type audio segment corresponding to one chord;

determining a plurality of second-type material segments of the audio material adjusted by the beat adjustment based on time point information of each of the plurality of second-type audio segments, each second-type material segment having one corresponding second-type audio segment, and time point information of each second-type material segment being the same as the time point information of the corresponding second-type audio segment; and adjusting a chord of each of the plurality of second-type material segments to the chord of the corresponding second-type audio segment.

Optionally, when the instruction in the storage medium are executed by the processor, the mobile terminal is further caused to perform to perform following operations:

determining a tonality of the target audio, the tonality being a temperament of a tonic of the target audio; and adjusting the chord of the audio material adjusted by the beat adjustment to a chord consistent with the determined tonality based on the tonality of the target audio.

Optionally, when the instruction in the storage medium are executed by the processor, the mobile terminal is further caused to perform to perform following operations:

selecting a target musical instrumental material from an audio material library, the audio material library comprising at least one musical instrumental material, each musical instrumental material being an audio having a designated beat and a designated time duration; and splicing the target musical instrumental material cyclically to obtain the audio material to be mixed, a time duration of the audio material to be mixed being the same as that of the target audio.

An embodiment of the present disclosure further provides a computer program product including instructions. When the computer program product is executed by a computer, the computer is caused to perform following operations:

acquiring an audio material to be mixed;

determining a beat feature of a target audio for audio mixing, the beat feature being a correspondence between a beat used in the target audio and time point information;

performing beat adjustment on the audio material based on the beat feature of the target audio; and performing audio mixing on the target audio based on the audio material adjusted by the beat adjustment.

Optionally, when the computer program product is executed by a computer, the computer is caused to perform to perform following operations:

segmenting the target audio into a plurality of first-type audio segments based on the beat feature of the target audio, each first-type audio segment corresponding to one beat;

determining a plurality of first-type material segments of the audio material to be mixed based on time point information of each of the plurality of first-type audio segments, each first-type material segment having one corresponding first-type audio segment, and time point information of each first-type material segment being the same as the time point information of the corresponding first-type audio segment; and adjusting a beat of each of the plurality of first-type material segments to the beat of the corresponding first-type audio segment.

Optionally, when the computer program product is executed by a computer, the computer is caused to perform to perform following operations:

performing chord adjustment on the audio material adjusted by the beat adjustment; and combining the audio material adjusted by the chord adjustment with the target audio.

O Optionally, when the computer program product is executed by a computer, the computer is caused to perform to perform following operations:

determining a chord feature of the target audio, the chord feature being a correspondence between a chord used in the target audio and time point information; and performing chord adjustment on the audio material adjusted by the beat adjustment based on the chord feature of the target audio.

Optionally, when the computer program product is executed by a computer, the computer is caused to perform to perform following operations:

segmenting the target audio into a plurality of second-type audio segments based on the chord feature of the target audio, each second-type audio segment corresponding to one chord;

determining a plurality of second-type material segments of the audio material adjusted by the beat adjustment based on time point information of each of the plurality of second-type audio segments, each second-type material segment having one corresponding second-type audio segment, and time point information of each second-type material segment being the same as the time point information of the corresponding second-type audio segment; and adjusting a chord of each of the plurality of second-type material segments to the chord of the corresponding second-type audio segment.

Optionally, when the computer program product is executed by a computer, the computer is caused to perform to perform following operations:

determining a tonality of the target audio, the tonality being a temperament of a tonic of the target audio; and adjusting the chord of the audio material adjusted by the beat adjustment to a chord consistent with the determined tonality based on the tonality of the target audio.

Optionally, when the computer program product is executed by a computer, the computer is caused to perform to perform following operations:

selecting a target musical instrumental material from an audio material library, the audio material library comprising at least one musical instrumental material, each musical instrumental material being an audio having a designated beat and a designated time duration; and splicing the target musical instrumental material cyclically to obtain the audio material to be mixed, a time duration of the audio material to be mixed being the same as that of the target audio.

Persons of ordinary skill in the art can understand that all or parts of the steps described in the above embodiments can be implemented through hardware, or through relevant hardware instructed by programs stored in a computer-readable storage medium, such as a read-only memory, a disk or a CD, etc.

The foregoing descriptions are merely exemplary embodiments of the present disclosure, and are not intended to limit the present disclosure. Within the spirit and principles of the present disclosure, any modifications, equivalent substitutions, improvements, etc., are within the protection scope of the present disclosure.

What is claimed is:

1. A method for mixing audio, comprising:

acquiring an audio material to be mixed;

determining a beat feature of a target audio for audio mixing, the beat feature being a correspondence between a beat style used in the target audio and first time point information, the beat style referring to a combination rule of strong beats and weak beats;

performing beat adjustment on the audio material based on the beat feature of the target audio; and performing audio mixing on the target audio based on the audio material adjusted by the beat adjustment, wherein the performing beat adjustment on the audio material based on the beat feature of the target audio comprises:

segmenting the target audio into a plurality of first-type audio segments based on the beat feature of the target audio, each first-type audio segment corresponding to one beat style;

determining a plurality of first-type material segments of the audio material to be mixed based on first time point information of each of the plurality of first-type audio segments, each first-type material segment having one corresponding first-type audio segment, and second time point information of each first-type material segment being the same as the first time point information of the corresponding first-type audio segment; and adjusting a beat style of each of the plurality of first-type material segments to the beat style of the corresponding first-type audio segment.

2. The method according to claim 1, wherein the performing audio mixing on the target audio based on the audio material adjusted by the beat adjustment comprises:

performing chord adjustment on the audio material adjusted by the beat adjustment; and combining the audio material adjusted by the chord adjustment with the target audio.

3. The method according to claim 2, wherein the performing chord adjustment on the audio material adjusted by the beat adjustment comprises:

determining a chord feature of the target audio, the chord feature being a correspondence between a chord used in the target audio and third time point information; and performing chord adjustment on the audio material adjusted by the beat adjustment based on the chord feature of the target audio.

4. The method according to claim 3, wherein the performing chord adjustment on the audio material adjusted by the beat adjustment based on the chord feature of the target audio comprises:

segmenting the target audio into a plurality of second-type audio segments based on the chord feature of the target audio, each second-type audio segment using one chord, chords used in the target audio comprising chords used in the plurality of second-type audio segments;

determining a plurality of second-type material segments of the audio material adjusted by the beat adjustment based on third time point information of each of the plurality of second-type audio segments, each second-type material segment having one corresponding second-type audio segment, and fourth time point information of each second-type material segment being the same as the third time point information of the corresponding second-type audio segment; and adjusting a chord of each of the plurality of second-type material segments to the chord of the corresponding second-type audio segment.

5. The method according to claim 2, wherein the performing chord adjustment on the audio material adjusted by the beat adjustment comprises:

determining a tonality of the target audio, the tonality being a temperament of a tonic of the target audio; and adjusting the chord of the audio material adjusted by the beat adjustment to a chord consistent with the determined tonality based on the tonality of the target audio.

6. The method according to claim 1, wherein the acquiring an audio material to be mixed comprises:

selecting a target musical instrumental material from an audio material library, the audio material library comprising at least one musical instrumental material, each musical instrumental material being an audio having a designated beat style and a designated time duration; and splicing the target musical instrumental material cyclically to obtain the audio material to be mixed, a time duration of the audio material to be mixed being the same as that of the target audio.

7. A computer-readable storage medium, on which instructions are stored, and when being executed by a processor, the instructions cause the processor to perform steps of the method as defined in in claim 1.

8. An apparatus for mixing audio, comprising:

an acquiring module, configured to acquire an audio material to be mixed;

a determining module, configured to determine a beat feature of a target audio for audio mixing, the beat feature being a correspondence between a beat style used in the target audio and first time point information, the beat style referring to a combination rule of strong beats and weak beats;

an adjusting module, configured to perform beat adjustment on the audio material based on the beat feature of the target audio; and a processing module, configured to perform audio mixing on the target audio based on the audio material adjusted by the beat adjustment, where the adjusting module is further configured to:

segment the target audio into a plurality of first-type audio segments based on the beat feature of the target audio, each first-type audio segment corresponding to one beat style;

determine a plurality of first-type material segments of the audio material to be mixed based on first time point information of each of the plurality of first-type audio segments, each first-type material segment having one corresponding first-type audio segment, and second time point information of each first-type material segment being the same as the first time point information of the corresponding first-type audio segment; and adjust a beat style of each of the plurality of first-type material segments to the beat style of the corresponding first-type audio segment.

9. The apparatus according to claim 8, wherein the processing module comprises:

an adjusting unit, configured to perform chord adjustment on the audio material adjusted by the beat adjustment; and a combining unit, configured to combine the audio material adjusted by the chord adjustment with the target audio.

10. The apparatus according to claim 9, wherein the adjusting unit is further configured to:

determine a chord feature of the target audio, the chord feature being a correspondence between a chord used in the target audio and third time point information; and perform chord adjustment on the audio material adjusted by the beat adjustment based on the chord feature of the target audio.

11. The apparatus according to claim 10, wherein the adjusting unit is further configured to:

segment the target audio into a plurality of second-type audio segments based on the chord feature of the target audio, each second-type audio segment using one chord, chords used in the target audio comprising chords used in the plurality of second-type audio segments;

determine a plurality of second-type material segments of the audio material adjusted by the beat adjustment based on third time point information of each of the plurality of second-type audio segments, each second-type material segment having one corresponding second-type audio segment, and fourth time point information of each second-type material segment being the same as the third time point information of the corresponding second-type audio segment; and adjust a chord of each of the plurality of second-type material segments to the chord of the corresponding second-type audio segment.

12. A terminal for use in audio mixing, comprising:

a processor; and a memory for storing instructions executable by the processor;

wherein the processor is configured to perform following operations:

acquiring an audio material to be mixed;

determining a beat feature of a target audio for audio mixing, the beat feature being a correspondence between a beat style used in the target audio and first time point information, the beat style referring to a combination rule of strong beats and weak beats;

performing beat adjustment on the audio material based on the beat feature of the target audio; and performing audio mixing on the target audio based on the audio material adjusted by the beat adjustment, wherein the processor is further configured to perform following operations:

segmenting the target audio into a plurality of first-type audio segments based on the beat feature of the target audio, each first-type audio segment corresponding to one beat style;

determining a plurality of first-type material segments of the audio material to be mixed based on first time point information of each of the plurality of first-type audio segments, each first-type material segment having one corresponding first-type audio segment, and second time point information of each first-type material segment being the same as the first time point information of the corresponding first-type audio segment; and adjusting a beat style of each of the plurality of first-type material segments to the beat style of the corresponding first-type audio segment.

13. The terminal according to claim 12, wherein the processor is further configured to perform following operations:

performing chord adjustment on the audio material adjusted by the beat adjustment; and combining the audio material adjusted by the chord adjustment with the target audio.

14. The terminal according to claim 13, wherein the processor is further configured to perform following operations:

determining a chord feature of the target audio, the chord feature being a correspondence between a chord used in the target audio and third time point information; and performing chord adjustment on the audio material adjusted by the beat adjustment based on the chord feature of the target audio.

15. The terminal according to claim 14, wherein the processor is further configured to perform following operations:

segmenting the target audio into a plurality of second-type audio segments based on the chord feature of the target audio, each second-type audio segment using one chord, chords used in the target audio comprising chords used in the plurality of second-type audio segments;

determining a plurality of second-type material segments of the audio material adjusted by the beat adjustment based on third time point information of each of the plurality of second-type audio segments, each second-type material segment having one corresponding second-type audio segment, and fourth time point information of each second-type material segment being the same as the third time point information of the corresponding second-type audio segment; and adjusting a chord of each of the plurality of second-type material segments to the chord of the corresponding second-type audio segment.

16. The terminal according to claim 13, wherein the processor is further configured to perform following operations:

determining a tonality of the target audio, the tonality being a temperament of a tonic of the target audio; and adjusting the chord of the audio material adjusted by the beat adjustment to a chord consistent with the determined tonality based on the tonality of the target audio.

17. The terminal according to claim 12, wherein the processor is further configured to perform following operations:

selecting a target musical instrumental material from an audio material library, the audio material library comprising at least one musical instrumental material, each musical instrumental material being an audio having a designated beat style and a designated time duration; and splicing the target musical instrumental material cyclically to obtain the audio material to be mixed, a time duration of the audio material to be mixed being the same as that of the target audio.

* * * * *